US012202098B1

(12) United States Patent
Arsenault

(10) Patent No.: US 12,202,098 B1
(45) **Date of Patent: *Jan. 21, 2025**

(54) SANDER VACUUM NOZZLE ATTACHMENT

(71) Applicant: Mark D. Arsenault, Stockton Springs, ME (US)

(72) Inventor: Mark D. Arsenault, Stockton Springs, ME (US)

( * ) Notice: Subject to any disclaimer, the term of this patent is extended or adjusted under 35 U.S.C. 154(b) by 6 days.

This patent is subject to a terminal disclaimer.

(21) Appl. No.: 18/099,391

(22) Filed: Jan. 20, 2023

(51) Int. Cl.
*B24B 55/10* (2006.01)
*A47L 7/00* (2006.01)
*B24B 23/02* (2006.01)

(52) U.S. Cl.
CPC ..... *B24B 55/102* (2013.01); *A47L 7/0095* (2013.01); *B24B 23/028* (2013.01)

(58) Field of Classification Search
CPC ..... B24B 7/186; B24B 23/005; B24B 23/02; B24B 23/028; B24B 55/06; B24B 55/10; B24B 55/102; B24B 55/105; A47L 9/24; A47L 7/0095
USPC ..... 451/344, 357, 359, 456
See application file for complete search history.

(56) References Cited

U.S. PATENT DOCUMENTS 2,270,151 A * 1/1942 Warren ..... B24B 55/102 29/DIG. 84
3,864,784 A * 2/1975 Kilstrom ..... A47L 11/4097 15/387
5,540,616 A * 7/1996 Thayer ..... B24D 15/023 451/354
6,648,742 B1 * 11/2003 Segiel, Jr. ..... B28D 7/02 83/100
6,796,889 B2 9/2004 Marton
7,033,259 B1 4/2006 Seasholtz et al.
7,270,598 B2 9/2007 Dutterer et al.
7,364,500 B2 4/2008 Brown
9,301,664 B1 * 4/2016 King, Jr. ..... B24B 55/10
9,358,665 B2 6/2016 Talbot et al.
9,616,549 B2 4/2017 Nabb
2003/0013396 A1 * 1/2003 Sun ..... B24B 55/102 451/456
2003/0032381 A1 2/2003 Dutterer et al.
2003/0083005 A1 * 5/2003 Price ..... B25F 5/006 451/344
2004/0154168 A1 * 8/2004 McDonald ..... B24B 27/08 30/390
2005/0281627 A1 * 12/2005 Britz ..... B23Q 11/0046 408/67
2006/0199484 A1 * 9/2006 Brown ..... B24D 15/04 451/523

(Continued)

*Primary Examiner* — Eileen P Morgan
(74) *Attorney, Agent, or Firm* — Cramer Patent & Design, PLLC.; Aaron R. Cramer

(57) ABSTRACT

The present invention provides a sander vacuum nozzle attachment also known as a dust wing adapter that captures dust while sanding by attaching to a sander and a vacuum system. It comprises of a hollow body with a central intake aperture that attaches to the dust bag mount of the sander and an outlet aperture that attaches to the suction hose of the vacuum system. The device also features a pair of wings that are placed adjacent to the sanding head and to the work surface, each wing has multiple wing intake apertures which allow dust to be drawn into the hollow body by the vacuum system. The design is efficient and compatible with orbital sander and mouse sander, and the shop vac is used as vacuum system.

1 Claim, 4 Drawing Sheets

(56) References Cited

U.S. PATENT DOCUMENTS

| | | | | |
|---|---|---|---|---|
| 2007/0161344 | A1 | 7/2007 | Clayton et al. | |
| 2009/0183800 | A1* | 7/2009 | Loveless | B23D 59/006 144/252.1 |
| 2011/0177763 | A1 | 7/2011 | Clayton | |
| 2012/0260456 | A1* | 10/2012 | King, Jr. | B23Q 11/0046 15/362 |
| 2013/0087357 | A1* | 4/2013 | King, Jr. | B23D 59/006 173/199 |
| 2013/0115863 | A1* | 5/2013 | Mizutani | B24B 55/10 15/246 |
| 2014/0357168 | A1* | 12/2014 | Nabb | B24B 55/10 451/456 |
| 2018/0125313 | A1* | 5/2018 | King, Jr. | A47L 9/248 |
| 2019/0247972 | A1* | 8/2019 | Kerestes | B24B 23/02 |
| 2020/0338689 | A1* | 10/2020 | Alvarez | B24B 55/102 |
| 2022/0402095 | A1* | 12/2022 | Soeda | B24B 55/102 |

* cited by examiner

SANDER VACUUM NOZZLE ATTACHMENT

RELATED APPLICATIONS

Non-applicable.

FIELD OF THE INVENTION

The present invention relates to sander vacuum nozzle attachment also known as a dust wing adapter.

BACKGROUND OF THE INVENTION

Sanding is a crucial step in any finishing project as it plays a vital role in determining the final outcome of the finished project. Many people opt for orbital/vibrating sanders to achieve a high-quality finish before applying paint or stain. However, sanding generates a lot of dust that can be a problem for both the worker and the surrounding environment. Many manufacturers have attempted to address this problem by adding dust collection bags to their sanders.

However, these bags tend to have holes in the sandpaper, which reduces its lifespan, and despite their presence, most of the dust still remains free to contaminate other surfaces and requires additional cleaning. To address this issue, a need for a more efficient and effective way of capturing dust from orbital/vibrating sanders was identified. The development of the sander vacuum nozzle attachment fulfills this need, providing a solution to the dust problems caused by sanding.

SUMMARY OF THE INVENTION

To achieve the above and other objectives, the present invention provides for a device (also known as a dust wing adapter) that captures dust while sanding by attaching to a sander and a vacuum system. It comprises of a hollow body with a central intake aperture that attaches to the dust bag mount of the sander and an outlet aperture that attaches to the suction hose of the vacuum system. The device also features a pair of wings that are placed adjacent to the sanding head and to the work surface. Each wing has multiple wing intake apertures which allow dust to be drawn into the hollow body by the vacuum system. The hollow body also has a tubular central portion with the central intake aperture at the front end and the outlet aperture at the rear end. The pair of wings are coupled to each side of the hollow body and are hollow with a hollow interior that communicates with the interior of the hollow body to allow air to flow through.

The attachment comprises a hollow body with central intake aperture and an outlet aperture, and a pair of wings. The central intake aperture is connected to the dust bag mount of a sander, while the outlet aperture is connected to a suction hose of a vacuum system. The pair of wings are placed adjacent to the sanding head and include wing intake apertures that capture the dust and direct it into the hollow body, where it exits through the outlet aperture before being collected by the vacuum system. The wings also have scooped apertures, which induce a more laminar flow of air. This device can be used with an orbital sander or a mouse sander and a vacuum system such as a shop vac.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTIVE KEY

Figure 1:
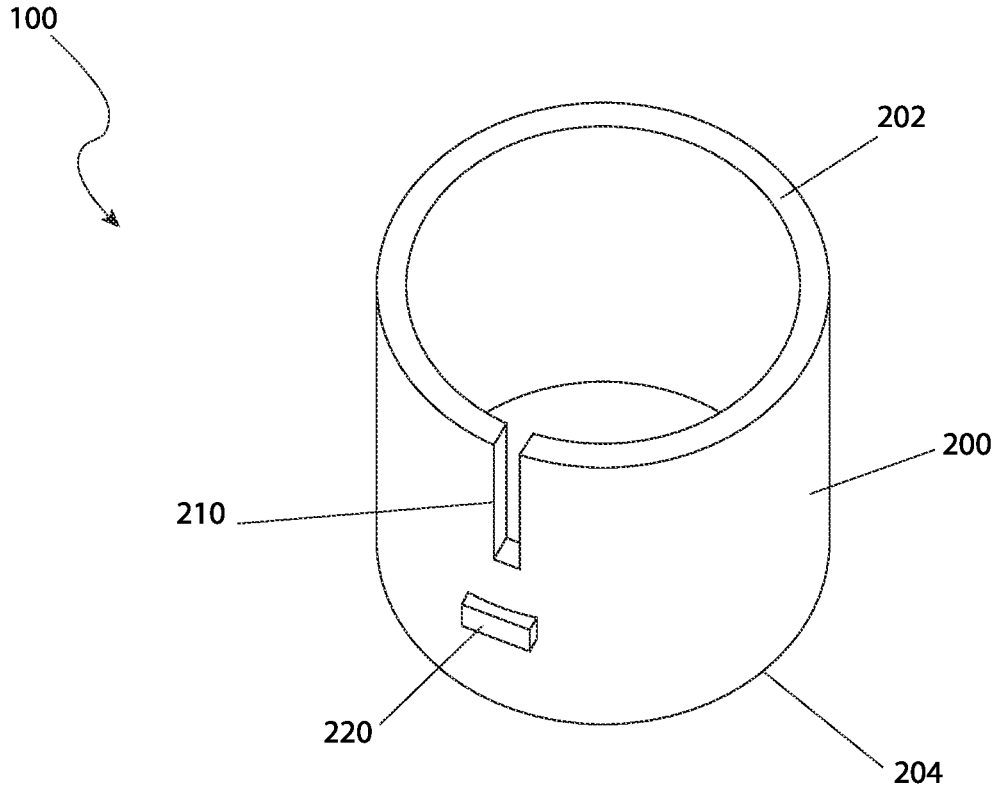
FIG. 1 is an isometric view of a dust wing adapter, according to an embodiment of the present invention.
Figure 2:
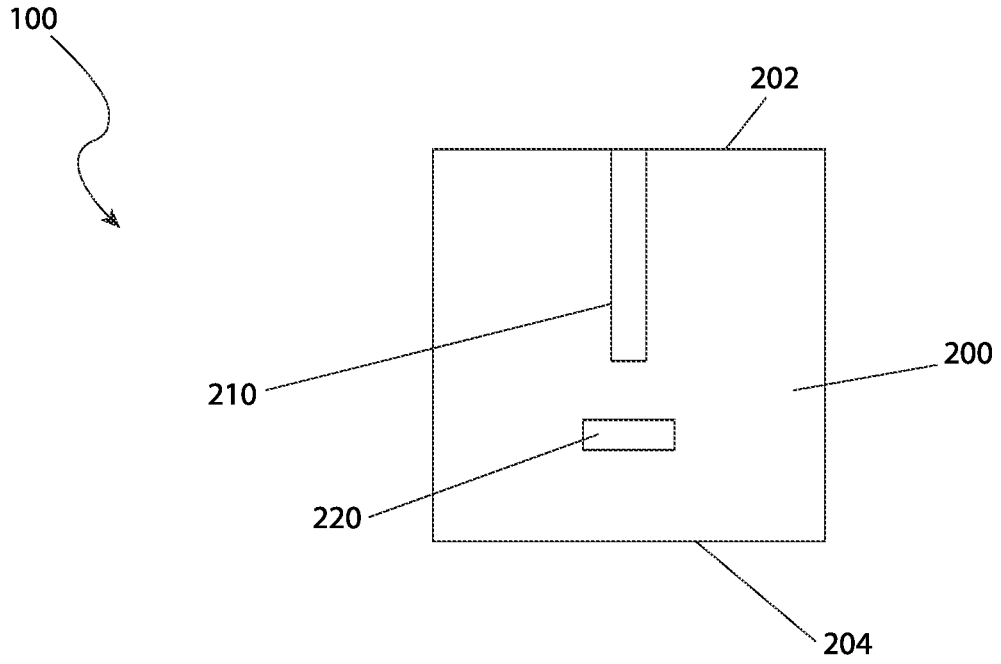
FIG. 2 is a front elevation view of a dust wing adapter, according to an embodiment of the present invention.
Figure 3:
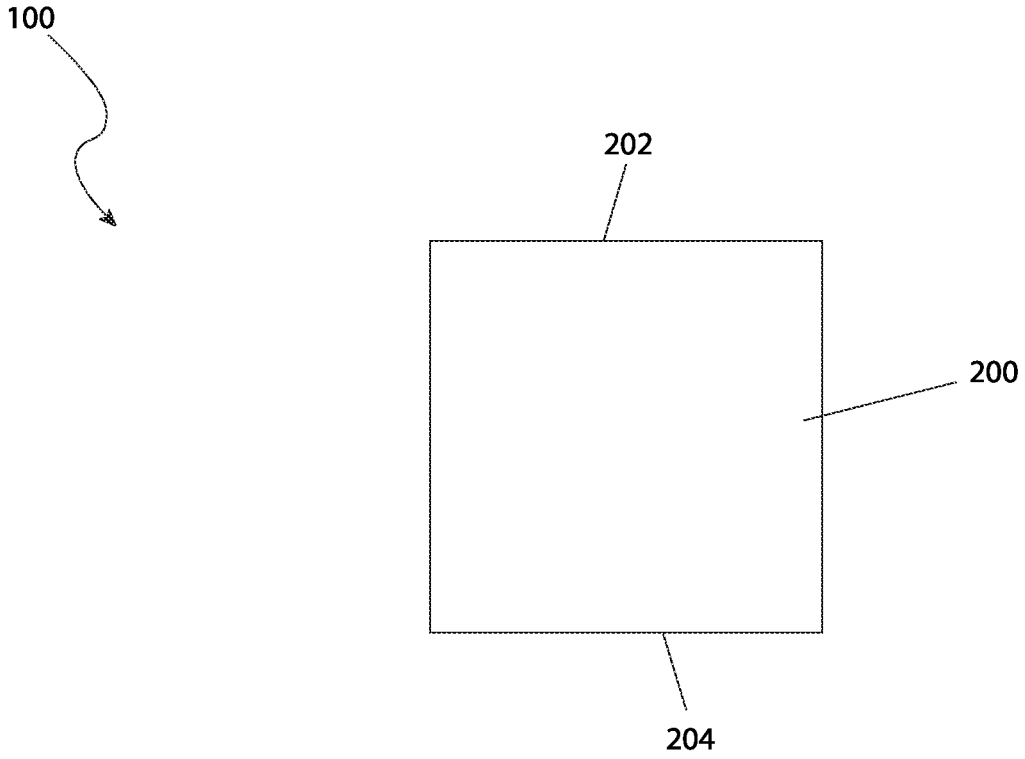
FIG. 3 is a rear elevation view of a dust wing adapter, according to an embodiment of the present invention.
Figure 4:
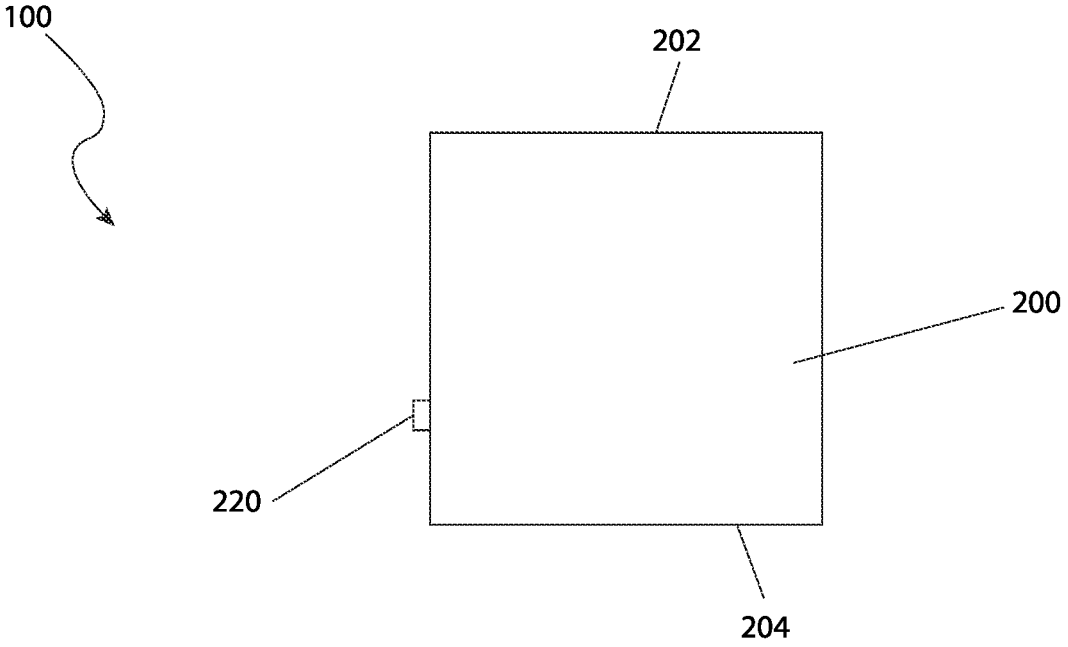
FIG. 4 is a side elevation view of a dust wing adapter, according to an embodiment of the present invention.
Figure 5:
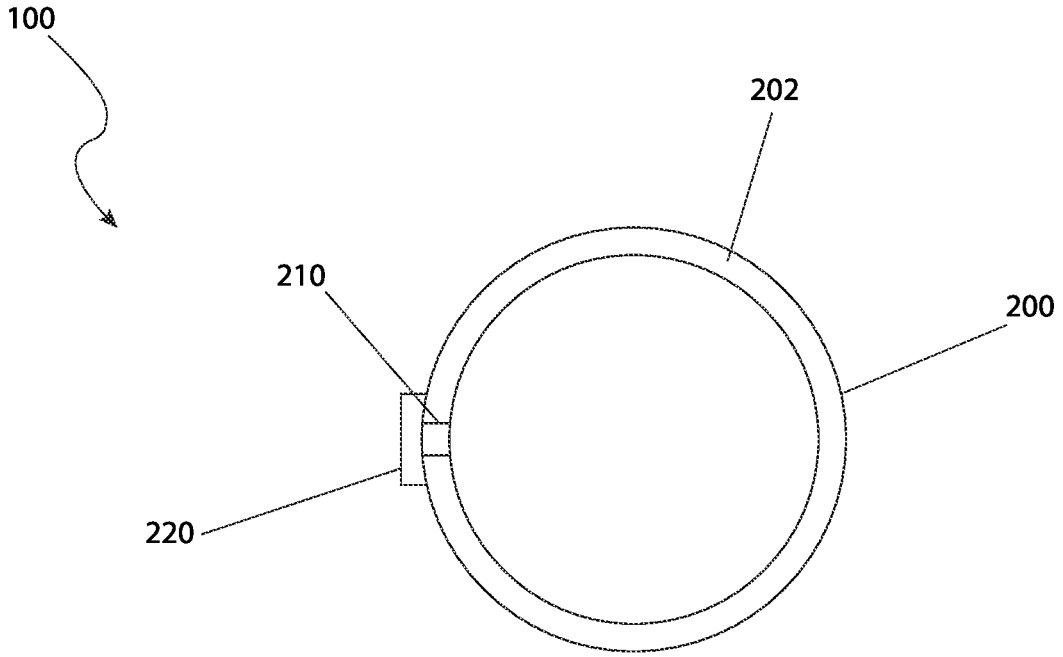
FIG. 5 is a top plan view of a dust wing adapter, according to an embodiment of the present invention.
Figure 6:
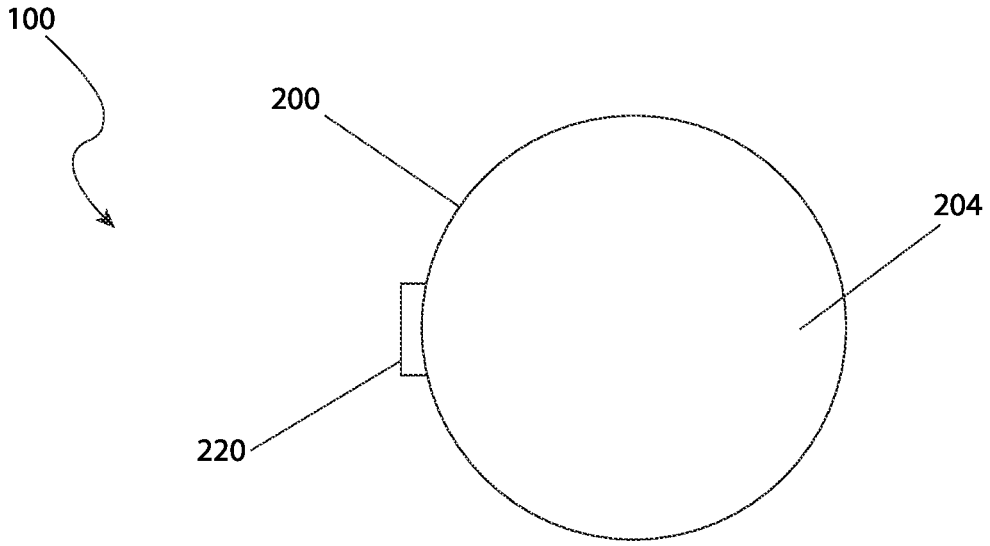
FIG. 6 is a bottom plan view of a dust wing adapter, according to an embodiment of the present invention.

100 dust wing adapter
200 tubular body
202 distal end
204 proximal end
210 slot
220 tab
900 sander
904 dustbag mount
908 sanding head
910 sander vacuum nozzle attachment
914 vacuum system coupler
916 pair of wings
918 sander coupler
932 hose clamp
942 guide pin
944 set screw aperture
946 coupling aperture

DESCRIPTION OF THE INVENTION

The present invention is directed to a dust wing adapter (herein described as the "invention") 100. The invention 100 may comprise a tubular body 200 having a proximal end 204 and a distal end 202, a slot 210, and a tab 220. The invention 100 may be operable to adapt the fit of a sander vacuum nozzle attachment 910 to a sander 900. The distal end 202 of the tubular body 200 may couple to a dustbag mount 904 of the sander 900. The proximal end 204 of the tubular body 200 may couple to a sander coupler 918 of the sander vacuum nozzle attachment 910.

The sander vacuum nozzle attachment 910 may be a device that directs dust produced by the operation of the sander 900 into a vacuum system. The sander vacuum nozzle attachment 910 may ordinarily couple directly to the dustbag mount 904 of the sander 900. A suction hose of the vacuum system may further couple to a vacuum system coupler 914 of the sander vacuum nozzle attachment 910. The sander vacuum nozzle attachment 910 may draw the dust through the dustbag mount 904 and through a pair of wings 916 positioned proximal to a sanding head 908 of the sander 900. When a mismatch exists between the size or shape of the dustbag mount 904 and the size or shape of the sander coupler 918, one (1) of a family of adapters may be inserted between the dustbag mount 904 and the sander vacuum nozzle attachment 910 to adapt the fit. A preferred embodiment of the invention 100 selected from the family of adapters is presented herein.

As a non-limiting example, the sander vacuum nozzle attachment 910 that is the subject matter of co-pending application U.S. Ser. No. 17/532,022, filed Nov. 22, 2021, and titled "Dustless sander vacuum nozzle attachment" may be an embodiment of the sander vacuum nozzle attachment 910 recited herein. The sander vacuum nozzle attachment 910 may also be referred to as a dust wing.

The tubular body 200 may be a hollow cylindrical tube. The distal end 202 of the tubular body 200 may couple with the dustbag mount 904 of the sander 900 by sliding over the dustbag mount 904. The proximal end 204 of the tubular body 200 may couple with the sander coupler 918 of the sander vacuum nozzle attachment 910 by sliding into the sander coupler 918.

The distal end 202 of the tubular body 200 may comprise the slot 210. The slot 210 may be operable to facilitate the coupling of the invention 100 to the sander 900. As a non-limiting example, the slot 210 may enable compression of the distal end 202 of the tubular body 200 by a hose clamp 932 tightened around the tubular body 200. The compression of the tubular body 200 may hold the tubular body 200 onto the dustbag mount 904. As a further non-limiting example, the dustbag mount 904 may comprise a guide pin 942 that may engage the slot 210 in order to prevent rotation of the invention 100 relative to the dustbag mount 904. As a further non-limiting example, the dustbag mount 904 may comprise a set screw aperture 944. A set screw may be coupled to the dustbag mount 904 after passing through the slot 210 in order to retain the invention 100 to the dustbag mount 904, prevent rotation of the invention 100 relative to the dustbag mount 904, or both.

The tubular body 200 may comprise the tab 220 located on the proximal half of the tubular body 200. The tab 220 may be operable to engage a coupling aperture 946 located on the sander coupler 918 of the sander vacuum nozzle attachment 910. Engaging the tab 220 with the coupling aperture 946 may retain the invention 100 to the sander vacuum nozzle attachment 910, may prevent rotation of the invention 100 relative to the sander vacuum nozzle attachment 910, or both.

The outside diameter of the tubular body 200 may be smaller than the inside diameter of the sander coupler 918 on the sander vacuum nozzle attachment 910 such that the tubular body 200 may slide into the sander vacuum nozzle attachment 910. The inside diameter of the tubular body 200 may be larger than the outside diameter of the dustbag mount 904 on the sander 900 such that the tubular body 200 may slide over the dustbag mount 904.

The tab 220 on the tubular body 200 may be smaller than the coupling aperture 946 on the sander vacuum nozzle attachment 910 such that the tab 220 may engage the coupling aperture 946. Specifically, a tab length measured in a longitudinal direction may be smaller than the longitudinal length of the coupling aperture 946 on the sander vacuum nozzle attachment 910 and a tab width measured tangentially may be smaller than the tangential width of the coupling aperture 946 on the sander vacuum nozzle attachment 910.

In some embodiments, a slot length measured in a longitudinal direction may be up to one-half (½) of the longitudinal length of the tubular body 200. In some embodiments, a slot width measured tangentially may be wider than the guide pin 942 or the set screw aperture 944 of the dustbag mount 904 on the sander 900.

Figure 7:
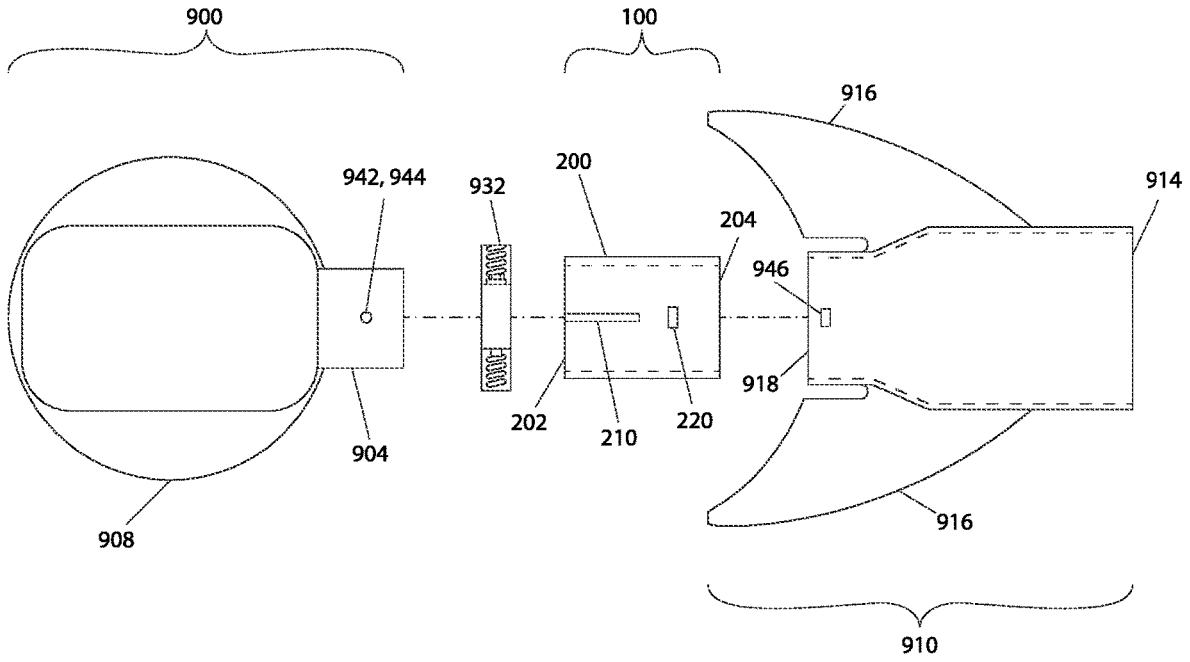
FIG. 7 is an exploded in-use view of a dust wing adapter, according to an embodiment of the present invention, illustrating the ordering of a sander, the dust wing adapter, and a sander vacuum nozzle attachment (aka dust wing) with a hose clamp for retention.

In use as illustrated in FIG. 7, the invention 100 may be coupled to the sander 900 and to the sander vacuum nozzle attachment 910 to adapt the fit of the sander 900 to the sander vacuum nozzle attachment 910. The invention 100 may be coupled to the sander 900 by sliding the distal end 202 of the tubular body 200 over the dustbag mount 904 of the sander 900. The invention 100 may be retained to the sander 900 and/or prevented from rotating by using the hose clamp 932, the guide pin 942, or the set screw. The invention 100 may couple with the sander vacuum nozzle attachment 910 by sliding the proximal end 204 of the tubular body 200 into the sander coupler 918 of the sander vacuum nozzle attachment 910 until the tab 220 engages the coupling aperture 946.

The exact specifications, materials used, and method of use of the invention 100 may vary upon manufacturing. The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated.

What is claimed is:

1. A dustless sander vacuum nozzle attachment, comprising:

a hollow body having a central intake aperture and an outlet aperture, the central intake aperture is adapted to couple to a dust bag mount of a sander;

wherein the outlet aperture is adapted to couple to a suction hose of a vacuum system;

wherein dust is adapted to be drawn through the dust bag mount and through a pair of wings positioned proximal to a sanding head of the sander;

wherein the hollow body includes a tubular central portion with the central intake aperture disposed at a front end of the hollow body and the outlet aperture disposed at a rear end of the hollow body;

wherein each of the pair of wings are coupled to an opposing side of the hollow body and extends laterally and forward;

wherein the pair of wings include a first wing disposed on a first side and a second wing on a second side;

wherein the pair of wings are hollow with a hollow interior;

wherein the hollow interior of the pair of wings couple to an interior of the hollow body such that air flows from the pair of wings into the hollow body;

wherein the dustless sander vacuum nozzle attachment directs dust from the sander into the vacuum system;

wherein dust exits the hollow body via the outlet aperture before being collected by the vacuum system;

wherein the sander is an orbital sander or a mouse sander; and, wherein the vacuum system is a shop vacuum.

* * * * *